United States Patent [19]

McGovarin

[11] 4,272,213

[45] Jun. 9, 1981

[54] EXTENDIBLE SCREEDS

[75] Inventor: Roy R. McGovarin, Rainham, Great Britain

[73] Assignee: Blaw Knox Limited, Rochester, England

[21] Appl. No.: 56,208

[22] Filed: Jul. 10, 1979

[51] Int. Cl.[3] ..... E01C 19/22

[52] U.S. Cl. ..... 404/118; 404/104

[58] Field of Search ..... 404/104, 106, 108, 118, 404/119

[56] References Cited

U.S. PATENT DOCUMENTS

| | | | |
|---|---|---|---|
| 3,557,672 | 1/1971 | Shurtz | 404/118 X |
| 3,572,227 | 3/1971 | Poulsen | 404/118 |
| 3,838,932 | 10/1974 | Glenewinkel | 404/118 X |
| 3,907,451 | 9/1975 | Fisher | 404/118 X |
| 3,957,384 | 5/1976 | Lamb | 404/118 |
| 3,992,124 | 11/1976 | Schrader | 404/118 |
| 4,129,399 | 12/1978 | Ruge | 404/118 |

*Primary Examiner*—Nile C. Byers, Jr.
*Attorney, Agent, or Firm*—Kemon & Estabrook

[57] ABSTRACT

This invention relates to road paving machines. Such machines are known in which there is a screed extending across the rear end of the machine and comprising two parts lying one behind the other. One part, the first, is fixed (except that it may be tilted and vibrated) relatively to the rest of the machine and the other part lies behind the first and is slidable along the first to enable the overall width of the screed to be varied. The second part is conventionally one of two similar parts that can be slid in opposite directions outwardly from retracted positions to project beyond the ends of the first part so that when the overall width of the screed is a maximum, the second parts project one from each end of the first.

In one form proposed for such apparatus, each second part is carried from the first by two telescopic supports extending in the direction of the width of the screed. The use of two supports is effective to prevent the second part from rotating about the axis of either of the supports and an object of the present invention is to enable only one telescopic support to be used while, at the same time preventing rotation of the second part about the axis of the support.

7 Claims, 4 Drawing Figures

4
3
-1-
2
17
11
10
12
-15-
16
41
44
18

EXTENDIBLE SCREEDS

DESCRIPTION

There is provided by the present invention a road paving machine having, extending across the rear of the machine, a screed of which the effective overall width is variable and comprising a first part and a second part extending, and reciprocable, along the first to vary the overall width of the screed, the second part being carried from the first by a telescopic support extending in the direction of the width of the screed and of which the outer section is fixed relatively to one of the parts and co-operates with a member that is fixed relatively to the other of the parts, the outer section having an outer surface that is non-circular in cross-section and the member co-operating with the outer surface in such a way that rotation of the member around the section is prevented but sliding of the member along the section is permitted and means acting between the parts by which one may be slid along the other.

By way of example, an embodiment of the invention will now be described with reference to the accompanying drawings in which.

Figure 1:
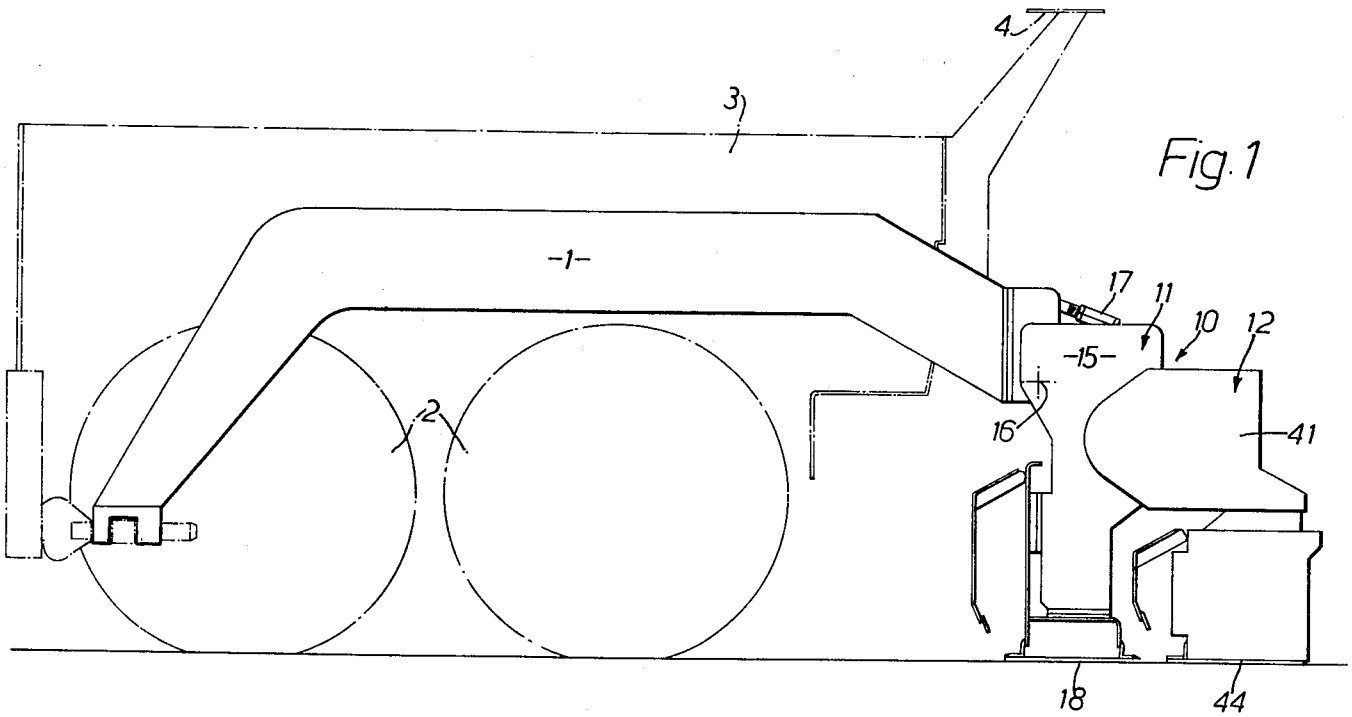
FIG. 1 is a somewhat diagrammatic representation of a side view of a road paving machine.

The road paving machine illustrated in FIG. 1 is largely of a kind that is known, differing from what is known essentially in the form of the screed that forms the rear end of the machine. In a known fashion, the machine includes a chassis 1 mounted on large diameter road wheels 2. The chassis 1 carries a platform 3 for the driver's seat 4 and, in front of the driver's seat and not specifically shown, a control pedestal and, in front of that, the power unit.

The screed is denoted generally by 10, and can be considered to consist of a first part 11 lying forwardly of two second parts 12. The screed is associated, in a known manner with means by which it can be vibrated. The first part 11 extends for the width of the paver. The two second parts 12 are independently reciprocable outwardly from positions in which they lie end-to-end and within the width of the first part 11 to positions in which they project laterally to opposite ends of the first part 11 and nearly double the effective width of the screed.

The first part 11 includes two plates 14 that are pivotally connected to the chassis 11 at 16, and turnbuckles 17 extending between the plates 14 and the chassis 1 enable the screed to be tilted within a small range to best suite the depth of the material that is being set by the paver. A sole plate 18 is connected to the bottom ends of the plates 14.

The second parts 12 are carried by the first part 11 through telescopic supports 30. Each telescopic support 30 and the second part 12 that is associated with it is a mirror image of the other, so only one will be described in detail.

Figure 4:
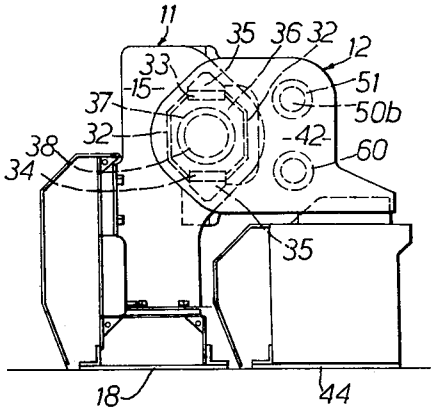
FIG. 4 is a section on the line IV—IV of FIG. 3.

Each telescopic support 30 has an outer section 31 which extends between the pair of plates 15 and is fixed at its ends to the plates. The outer section 31 is of generally octagonal section and is formed from two side plates 32 welded to top and bottom plates 33 and 34 extending between them. Similar, outwardly convergent, ridge members 35 are bolted along their lengths to the top and bottom plates. Within the outer section 31, at locations spaced apart along its length, are liner blocks 36 (FIG. 4) having circular bores co-axial with the outer section 31 and within these bores slide the intermediate section 37 of the telescopic support. The intermediate section 37 acts as a slide for the inner section 38, the outer end of which is fixed to the end plate 41 of the associated second part 12.

Each second part 12 provided at the end that is outermost the end plate 41 and at the other end a guide member 42. The plate 41 and guide member 42 are rigidly connected together and provide support, through the connectors 43, for the sole plate 44. The guide member 42 is formed from two parts **42*a* and 42*b* clamped together, the opposing edges of the parts 42*a* and 42*b* providing an opening within which the outer section 31 is enclosed. The opening has diametrically opposed guide sections 45 which co-operate with the ridge members 35 so as to permit the guide member 42 to slide along the outer section 31 yet prevent the guide member 42**, and the rest of the second part that is rigidly associated with it, from swinging about the axis of the telescopic support.

Thus, the second part 12 can be reciprocated parallel to, and behind, the first part 11 with co-operation between the guide member 42 and the ridge members 35 inhibiting axial rotation of the second part and the telescopic support 30 acting to maintain the second part 12 at a constant orientation to the horizontal.

To move the second parts 12, hydraulic piston and cylinder devices are provided. The device by which the right hand second part 12 can be moved is shown at 50. The device passes through an opening 51 in the guide member 42 and extends across the plate 14 that lies at the extreme right hand end of the screed. The free end of the piston **50*a* is connected to the end plate 41 whilst the free end of the cylinder 50*b* is connected to a "top hat" or hollow stub 52 fixed to the central pair of plates 14, i.e. plate 14*a*. The cylinder extends through an opening in the other of the plates 14, i.e. 14*b*, and through an opening in the plates 14*a* to project into that pair stub 52. The stub 52 projects away from the plate 14*b* and forms an anchor for the end of the cylinder. By use of the stub 52, it is possible to move the second part 12 through a greater range than could be effected if the device 50 extended simply from the plate 14*b* to the plate 41**.

Movement of the other second part 12 is affected through a similar, and similarly mounted, piston and cylinder device 150 entering stub 152 the device 150 being disposed vertically below the device 50.

Each of the devices 50 and 150 can be operated independently of the other and when either has been operated to displace the associated part 12 to the maximum from its retracted position, the guide member 42 abuts the end plate 14. When the devices 50 and 150 have been operated to move the associated second parts 12 to their most retracted position, the two second parts 12 lie end-to-end within the length of the first part 11. When the second parts are in these relative positions, the stub, such as 152, of each is received within an opening, such as 60, in the guide member 42 of the other.

Figure 2:
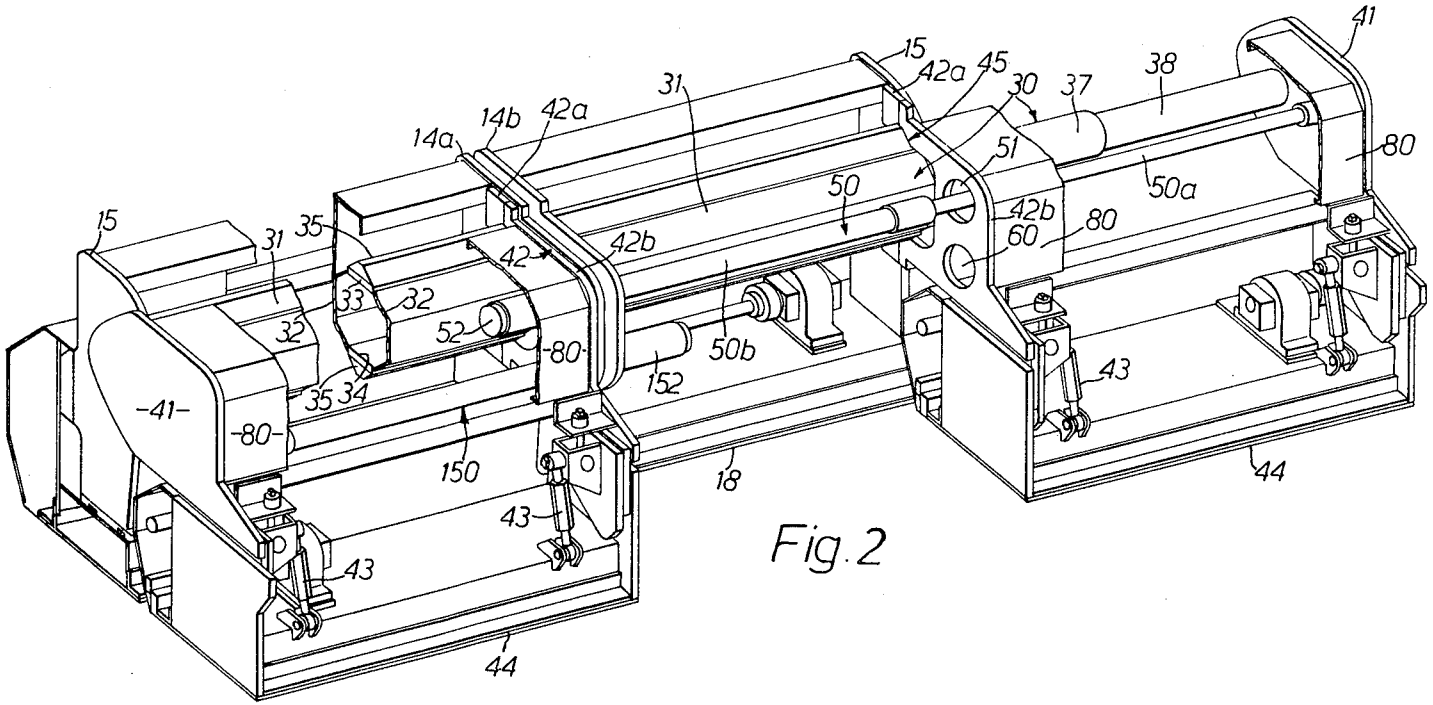
FIG. 2 is a perspective view, partly cut away, of the screed forming the rear-part of the machine illustrated in FIG. 1.
Figure 3:
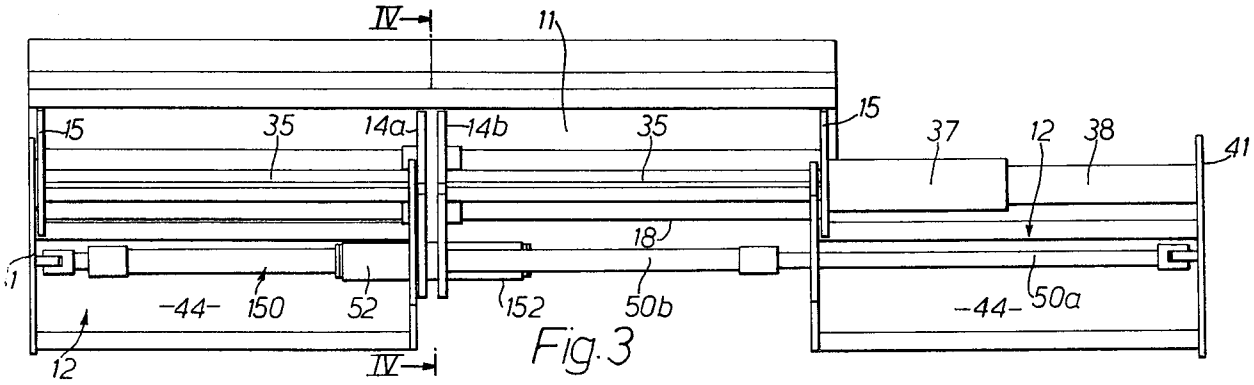
FIG. 3 is plan view of the screed shown in FIG. 2.

The sections 37 and 38 of the telescopic supports are always covered by the shielding 80 which is shown partly cut away in FIG. 2 and is excluded from FIG. 3.

I claim:

1. A road paving machine having, extending across the rear of the machine, a screed of which the effective overall width is variable and comprising a first part and a second part extending, and reciprocable, along the first to vary the overall width of the screed, the second part being carried from the first by a telescopic support extending in the direction of the width of the screed and of which the outer section is fixed relatively to one of the parts and co-operates with a member that is fixed relatively to the other of the parts, the outer section having an outer surface that is non-circular in cross-section and the member co-operating with the outer surface in such a way that rotation of the member around the section is prevented but sliding of the member along the section is permitted, and means acting between the parts by which one may be slid along the other.

2. A road paving machine as claimed in claim 1 in which the outer section extends between, and is fixed to, spaced supports that are incorporated in the first part.

3. A road paving machine as claimed in claim 2 in which at each end of the range of movement of the second part relative to the first, the member abuts one of the spaced supports.

4. A road paving machine as claimed in claim 1 in which the outer surface is provided with two diametrically opposed, outwardly projecting ridges.

5. A road paving machine as claimed in claim 4 in which the ridges are vertically one above the other.

6. A road paving machine as claimed in claim 1 in which the second part is one of two parts that, and, when the overall width of the screed is a maximum, project to equal extents from the first part to opposite ends of the first part.

7. A road paving machine as claimed in claim 6 in which when the overall width of the screed is a minimum, the outer ends of the second part lie one at each of the ends of the first part.

* * * * *